United States Patent [19]

Goekler et al.

[11] Patent Number: 4,610,403

[45] Date of Patent: Sep. 9, 1986

[54] PIPE TAPE TENSIONER

[75] Inventors: Robert G. Goekler, Owasso; Gary N. King, Tulsa, both of Okla.

[73] Assignee: CRC Pipeline International, Inc., Fort Worth, Tex.

[21] Appl. No.: 575,442

[22] Filed: Jan. 30, 1984

[51] Int. Cl.[4] ..... B65H 81/08; B65H 23/10

[52] U.S. Cl. ..... 242/7.23; 57/15; 156/428; 188/71.6; 226/183; 242/75.2; 242/76

[58] Field of Search ..... 242/7.21, 7.22, 7.23, 242/75.2, 76; 156/428; 57/3, 10, 11, 13, 14, 15, 16, 17, 18; 226/183; 188/71.6

[56] References Cited

U.S. PATENT DOCUMENTS

| | | | |
|---|---|---|---|
| 2,552,571 | 5/1951 | Mercier | 188/264 CC |
| 2,657,866 | 11/1953 | Lungstrom | 242/7.22 |
| 3,128,216 | 4/1964 | Reed | 242/7.22 |
| 3,985,277 | 10/1976 | Wright | 226/183 |
| 4,415,067 | 11/1983 | Cory | 188/71.6 |

*Primary Examiner*—Billy S. Taylor

*Attorney, Agent, or Firm*—Richards, Harris, Medlock & Andrews

[57] ABSTRACT

A pipe tape tensioner (26) is disclosed for applying tape (12) with constant tension to a pipe (14). The pipe tape tensioner (26) employs a primary roller (32) rotatably mounted on a base (34). First clutch disks (92) and second clutch disks (100) are urged against each other by clutch springs (104) to generate a frictional resistance to rotation of the primary roller relative to the base (34) to tension the tape (12) engaged with the outer surface (36) of the primary roller (32). The first clutch disks (92) are splined to the splines (58) formed on the interior of the base (34). The second clutch disks (100) are splined to the hub (96) of the primary roller (32). A cooling fluid can be employed to cool the splines and surrounding components.

8 Claims, 8 Drawing Figures

PIPE TAPE TENSIONER

TECHNICAL FIELD

This invention relates to the wrapping of pipe with a material, such as tape, and, in particular, to the tensioning of the material as it is placed on the pipe.

BACKGROUND ART

It is often desirable to wrap a material about a pipe to enhance performance of the pipe in a given application. For example, multiple layers of tape can be wrapped about the outer surface of a pipe to resist pipe corrosion or to insulate the pipe, either electrically or thermally.

Pipe is commonly wrapped by passing through a special wrapping device which applies multiple layers of tape simultaneously. Generally, a large annular ring is rotated about the outer circumference of the pipe being wrapped. The annular ring supports multiple tape rolls from which the tape is supplied for wrapping the pipe. Once the wrapping has begun, the annular ring simply rotates in one direction while the pipe is drawn through the wrapping device to wrap multiple layers of tape about the pipe.

As the tape is being wrapped about the pipe, some type of tensioning device is required to tension the tape. In the past, a brake has been mounted on the individual tape supply reels to resist rotation of the tape reel. The resistance to rotation of the tape supply reel tensions the tape as it is wrapped about the pipe. However, with the brake set at a given frictional level, the tension of the tape applied to the pipe varys as the supply reel is depleted. Typically, the tension is too low when the supply reel is full and is too high as the supply reel becomes empty.

Therefore, a need exists for an improved tensioner device for use with conventional pipe wrapping devices. The improved tensioning device should provide constant tension to the tape as it is wrapped about the pipe with the tension being independent of the amount of tape remaining on the supply reel.

SUMMARY OF THE INVENTION

In accordance with one aspect of the present invention, a device is provided for exerting a constant tension on a material for wrapping about a pipe. The material is provided from a material source with the material source and pipe moving relative to each other about the circumference of the pipe. The device includes a base for movement about the circumference of the pipe with the material source. A primary shaft is rotatably mounted to the base and frictionally engages the material about a portion of its outer surface. Structure is provided for exerting a constant friction force resisting rotation of the primary shaft relative to the base for tensioning the material as it is applied to the pipe.

In accordance with another aspect of the present invention, the tensioning device includes a base moving about the pipe with the material source which has an aperture formed therein with the aperture being splined. A primary shaft is rotatably mounted on the base. The primary shaft includes a hub extending into the aperture of the base with the hub also being splined. At least one first clutch disk is splined to the base within the aperture and at least one second clutch disk is splined to the hub of the primary shaft within the aperture. An adjusting nut is threadably received in the aperture. Spring structure is provided for urging the clutch disks into contact to generate frictional resistance to rotation of the primary shaft relative to the base. The clutch disks are positioned between the adjusting nut and spring structure so that movement of the adjusting nut varies the force exerted by the spring structure on the clutch disks to vary the frictional resistance to rotation. The material in frictional engagement with the outer surface of the primary shaft is thereby tensioned.

BRIEF DESCRIPTION OF THE DRAWINGS

A more complete understanding of the invention and its advantages will be apparent from the following detailed description when taken in conjunction with the accompanying Drawings, in which.

DETAILED DESCRIPTION

Figure 1:
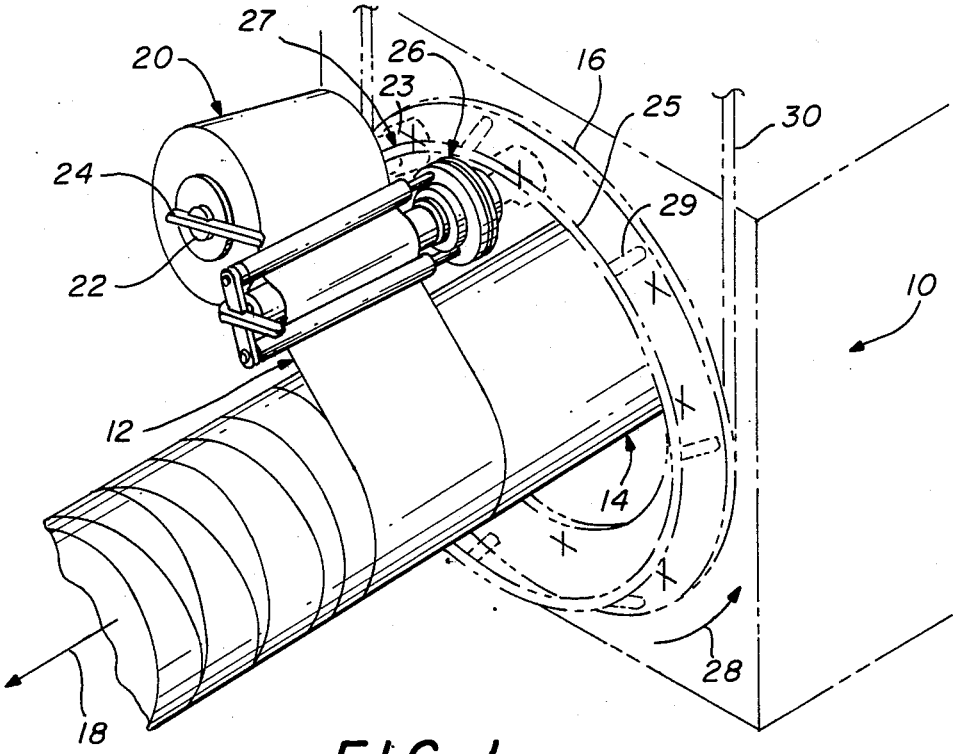
FIG. 1 is a perspective view of a pipe wrapping machine employing the pipe tape tensioner of the present invention.

Referring now to the drawings, wherein like reference characters designate like or corresponding parts throughout several views, and in particular to FIGS. 1–4, a pipe wrapping machine 10 is illustrated which operates to wrap tape or material 12 about a pipe 14. It will be understood that tape 12 will encompass any material desired to be wrapped about the pipe 14. In turn, pipe 14 will encompass any pipe, tube, rod or other structure which is to be wrapped with tape 12.

In operation, the pipe wrapping machine 10 employs a rotating annular ring 16 which rotates about the outer circumference of pipe 14 while the pipe is moved through the machine in the direction of arrow 18. The annular ring 16 is rotated in the direction of arrow 28 by any suitable drive mechanism. The annular ring 16 illustrated in FIG. 1 is driven through a chain 30 which, in turn, is driven by a drive mechanism, not shown. One or more tape supply reels 20 are mounted on tape supply shafts 22 secured to the annular ring 16. The tape supply reels 20 are freely rotatable on the tape supply shafts 22 but are restricted from motion along the tape supply shafts 22 by clamps 24.

The tape supply shafts 22 are preferably mounted directly to ring 16 by a base 23 and further supported by a bracing ring 25 and brace arm assembly 27 as seen in FIG. 1. The bracing ring 25, in turn, is supported on annular ring 16 through struts 29. The ring 25, brace arm assembly 27 and structs 29 are shown only in FIG. 1 to better illustrate the tape tensioning apparatus in the other figures. While the tape supply shafts 22 can be mounted on annular ring 16 by bases 23 alone, the stress of the heavy tape supply reels 20, often as heavy as 165 pounds per roll, on shafts 22 and bases 23, at times increased by the centrifugal force generated by the rotating ring 16 and the tension of the tape 12 being drawn off the reels 20, make use of the bracing ring 25, brace arm assembly 27 and struts 29 desirable to ensure that the reels 20 remain in a fixed relation to ring 16. U.S. Pat. No. 4,461,429 issued July 24, 1984, naming Robert G. Goekler and Charles W. Hunt as inventors, and assigned to the assignee of the present application, is hereby incorporated by reference. U.S. Pat. No. 4,461,429 describes and claims the advantages of supporting tape supply shafts with a bracing ring. In U.S. Pat. No. 4,461,429, wrapping sprocket 14, tape rolls 22, tape roll support spindles 34, bases 36, brace arm assemblies 69, ring 66 and struts 50 correspond, respectively, to annular ring 16, tape supply reels 20, tape supply shafts 22, bases 23, brace arm assemblies 27, bracing ring 25 and struts 29 in the present application.

A pipe tape tensioner 26 is also mounted on the annular ring 16 adjacent each of the supply reels 20. The pipe tape tensioner 26 acts to tension the portion of the tape 12 between the pipe tape tensioner and the pipe 14 during application of the tape to insure a tight wrap about the pipe As will be apparent, the pipe tape tensioner 26 provides a constant tension to the tape, independent of the amount of tape remaining on the tape supply reel 20.

Figure 2:
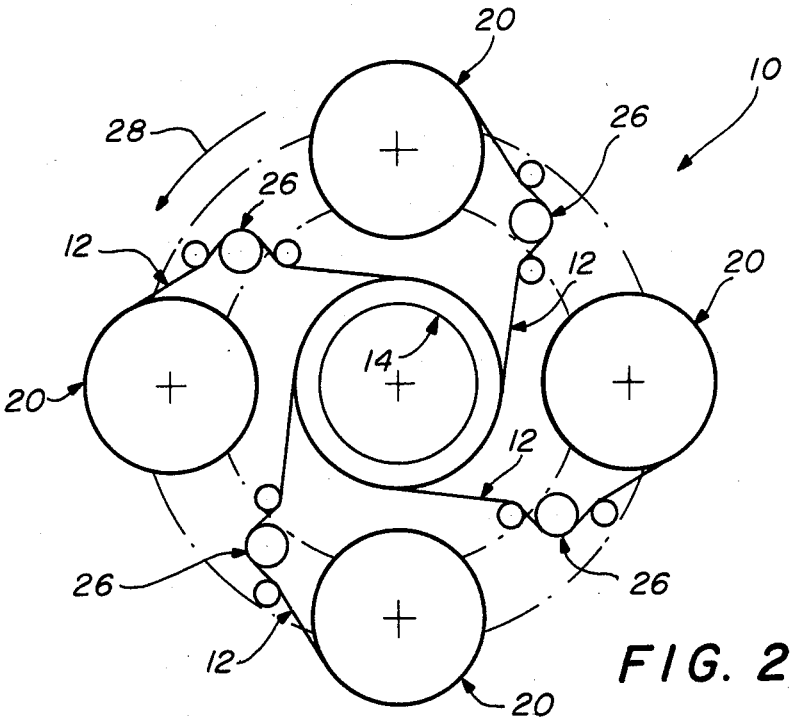
FIG. 2 is a schematic end view of the pipe tape wrapping machine illustrating the use of multiple tape supply rolls to wrap the pipe with multiple layers.

As can be seen in FIG. 2, a plurality of tape supply reels 20 can be provided on a single pipe wrapping machine 10 to wrap the pipe with multiple layers simultaneously. FIG. 2 illustrates the use of four tape supply reels 20 and four pipe tape tensioners 26. In this configuration, two of the pipe tape tensioners 26 extend further from the annular ring 16 than the other tensioners and are preferably supported by the bracing ring 25 as well as mounted directly to ring 16. Of course, all tensioners can be supported from ring 25 if desired.

Figure 3:
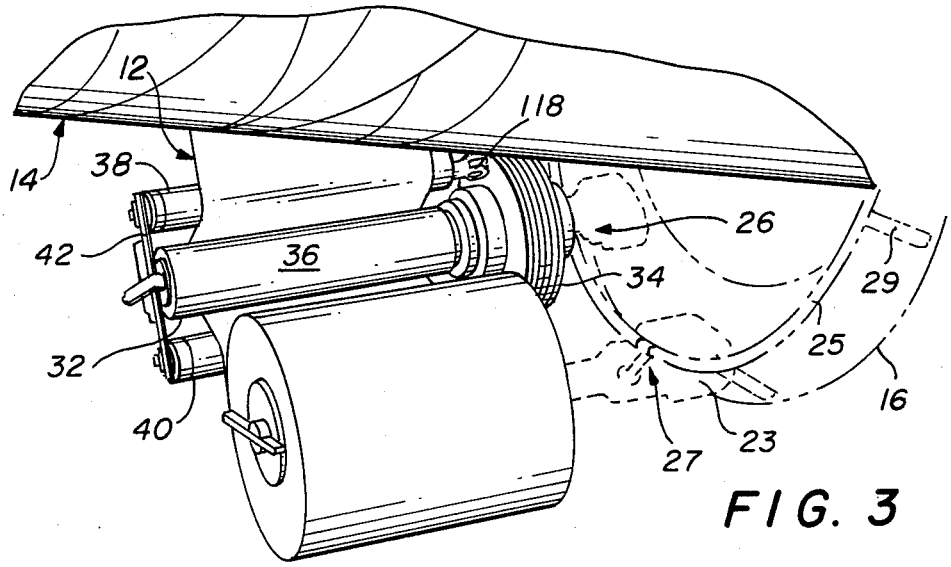
FIG. 3 is a perspective view of the pipe wrapping machine with the tape threaded through the pipe tape tensioner to tension the tape.
Figure 4:
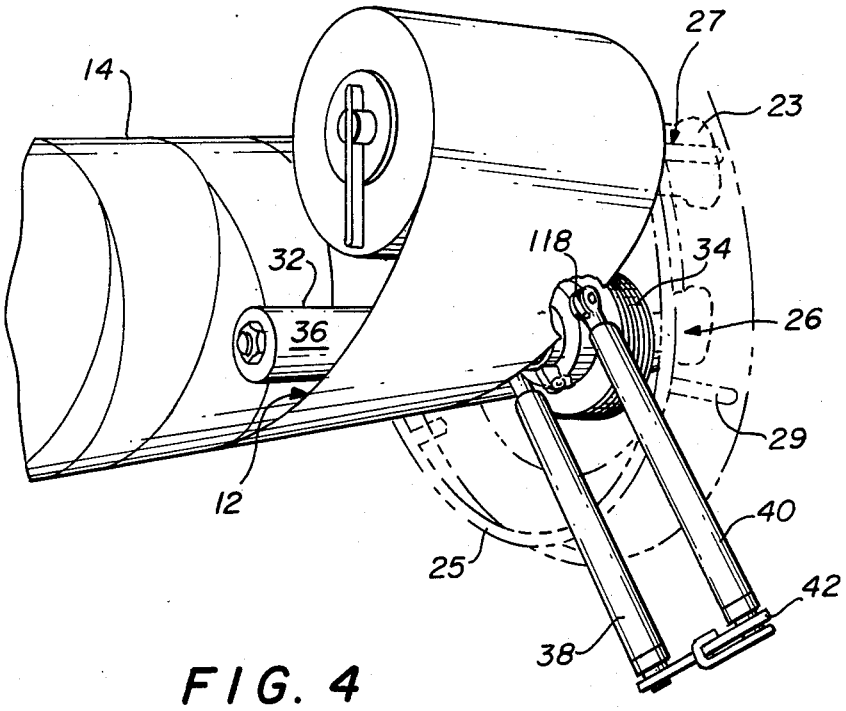
FIG. 4 is a perspective view of the pipe wrapping machine illustrating the secondary rollers of the pipe tape tensioner pivoted away from the primary roller to thread the tape on the pipe tape tensioner.

With reference now to FIGS. 3 and 4, the general operation of the pipe tape tensioner 26 can be described. The pipe tape tensioner includes a primary roller 32 which is rotatably mounted to a base 34 mounted on the annular ring 16. Tape 12 is engaged about a portion of the outer surface 36 of the primary roller 32 as best seen in FIG. 4. Secondary rollers 38 and 40 are pivotally hinged to the base 34 on opposite sides of the primary roller 32 and are connected at the ends remote from the base 34 by a bracket 42.

When it is desirous to begin application of the tape 12, the secondary rollers 38 and 40 are pivoted away from the primary roller as shown in FIG. 4 and tape 12 is laid over a portion of the primary roller and the pipe. Subsequently, the secondary rollers 38 and 40 are pivoted adjacent the primary roller to define a path for tape 12 through the pipe tape tensioner 26 which requires the tape to contact a substantial portion of the outer surface 36 of the primary roller 32.

As will be described hereinafter, the pipe tape tensioner 26 includes structure for creating a constant frictional resistance to rotation of the primary roller 32 relative to the base 34. This constant frictional resistance, in combination with the frictional contact between the tape 12 and the outer surface 36 of the primary roller 32 tensions the tape between the primary roller 32 and the pipe 14. The constant frictional resistance to rotation of the primary roller 32 can be varied to adjust the tension in the tape 12. As will be apparent, the tension on tape 12 will be independent of the supply of tape 12 remaining on the tape supply reels 20. Pipe tape tensioner 26 therefore provides much greater control over the tape tension than could previously be achieved.

Figure 5:
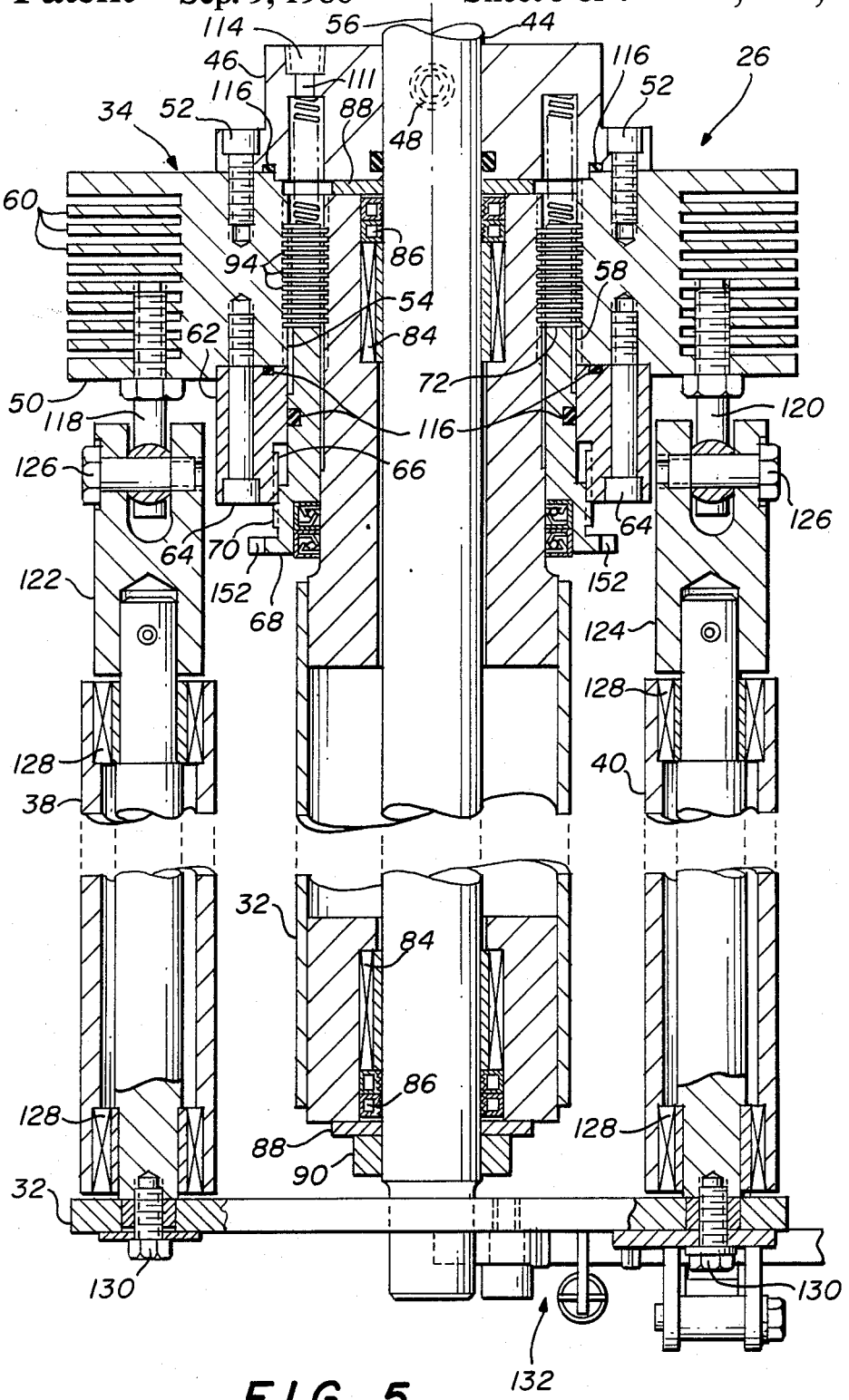
FIG. 5 is a cross-sectional view of the pipe tape tensioner.
Figure 7:
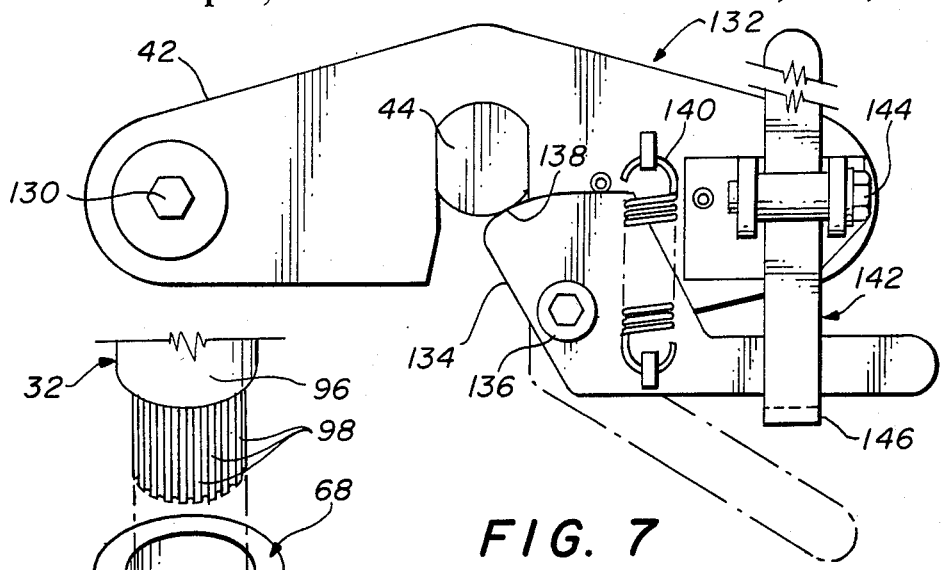
FIG. 7 is an end view of the pipe tape tensioner illustrating the roller bracket and clamp.
Figure 6:
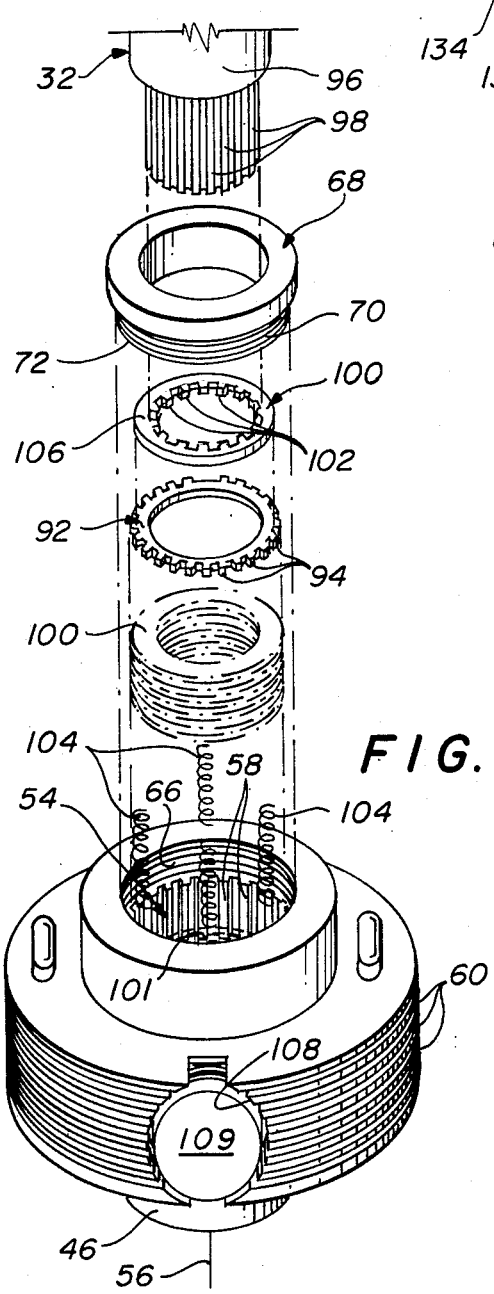
FIG. 6 is an exploded view of the internal components of the pipe tape tensioner.

With reference now to FIGS. 5–7, the pipe tape tensioner 26 will be described in greater detail. The base 34 includes a primary shaft 44 which is secured at one end to the annular ring 16. A cap 46 is secured along the length of the primary shaft 44 by a set screw 48. A clutch housing 50 is secured to the cap 46 by bolts 52. The clutch housing defines an aperture 54 therein centered on axis 56 as best seen in FIG. 6. The walls of the aperture 54 include splines 58. A number of cooling fins 60 are formed on the outer periphery of the clutch housing 50 for cooling the housing.

An adjusting nut housing 62 is bolted to the clutch housing 50 on the side opposite the cap 46 by additional bolts 64. The inner perimeter of the end of housing 62 distal from the clutch housing 50 is formed with threads 66 for receiving adjusting nut 68 having threads 70. As can be seen in FIGS. 5 and 6, a portion of the adjusting nut 68 extends into the aperture 54 and defines annular end surface 72.

The primary roller 32 is rotatably mounted on the primary shaft 44 by bearings 84 with seals 86. The primary roller 32 is prevented from motion along the axis 56 by thrust washers 88 and a collar 90.

A plurality of first clutch disks 92 are positioned in the aperture 54. Each clutch disk 92 has splines 94 about its outer periphery for engaging the splines 58 within aperture 54. The engagement of splines 58 and 94 insure that the first clutch disks 92 will not rotate relative to the base 34 about axis 56 but will permit the disks 92 to slide along the axis 56.

The primary roller 32 has a hub 96 which extends into the aperture which has splines 98 formed on the outer surface thereof parallel the axis 56. Second clutch disks 100 are positioned within the aperture 54 and interleaved between the first clutch disks 92. Each of the second clutch disks 100 has splines 102 formed about its inner surface for engaging the splines 98 on the hub 96 of the primary roller 32. The second clutch disks will therefore rotate with the primary roller 32 but will be permitted to slide along the axis 56 relative to the primary roller 32.

A plurality of clutch springs 104 are positioned within the aperture 54 and act between the cap 46 and the most immediate clutch disk 92 or 100. The clutch springs 104 act to compress the disks 92 and 100 together and against the annular end surface 72 of the adjusting nut 68. The second clutch disks 100 are preferably provided with friction surfaces 106 on both sides thereof, as best seen in FIG. 6. These friction surfaces 106 will come into intimate contact with these abutting surfaces of the first clutch disks 92 under the influence of the clutch springs 104. As will be apparent, the friction surfaces 106 will generate friction between the first and second clutch disks as the primary roller 32 rotates relative to the base 34. The magnitude of this resistance can be varied by screwing the adjusting nut 68 either toward or away from the cap 46 to further compress the clutch springs or relieve the compression on the clutch springs, respectively. Naturally, the greater the tension that the clutch springs 104 exert on the disks 92 and 100, the greater the magnitude of the friction or resistance to rotation of the primary roller 32.

While friction surfaces 106 are provided on the second clutch disks 100, those friction surfaces can be as readily transferred to the first clutch disks 92. In the alternative, friction surfaces can be provided on both disks 92 and 100 or only on selected disks.

Figure 8:
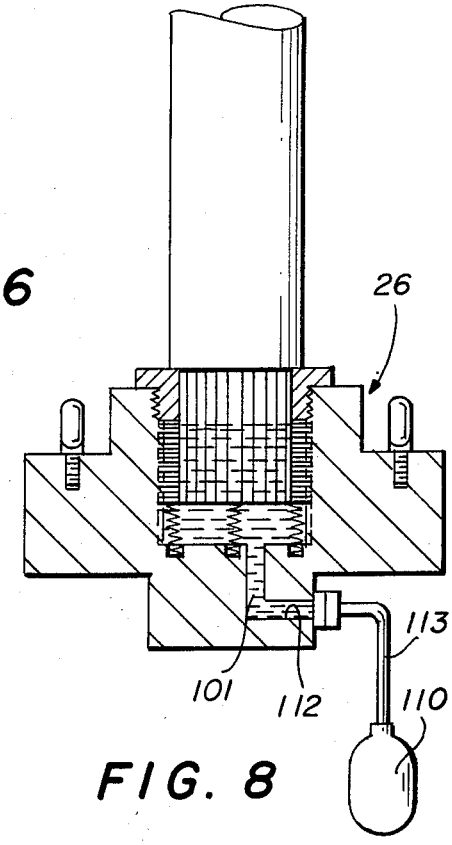
FIG. 8 illustrates a first modification of the pipe tape tensioner.

In the preferred embodiment, a coolant 101, such as ethylene glycol, is provided within the aperture 54 for cooling the components. To improve circulation of the cooling fluid, several splines 98 can be removed from the hub 96 to provide coolant passages. In the alternative, splines 58 can be removed from the clutch housing 50, splines 94 can be removed from the first clutch disks 92 as shown in FIG. 6 or splines 98 can be removed from the second clutch disk 100 or any combination thereof. An aperture or cutout 108 is preferably formed in a portion of the clutch housing 50 which contains an expansion chamber 109 into which the coolant 101 can flow. The expansion chamber 109 has a flexible diaphram exposed to the atmosphere on one side and coolant 101 on the other side which permits thermal expansion and contraction of the cooling fluid as the coolant is heated and cooled. A fill port can be used to fill the clutch housing 50 with coolant 101 and is normally closed by a pipe plug 114. In a first modification illustrated in FIG. 8, a separate expansion tank 110 can be employed for thermal expansion or contraction of the cooling fluid which is connected to the pipe tape tensioner 26 through a port 112 and tube 113. Appropriate seals 116 can be employed to prevent loss of the cooling fluid from the aperture 54.

Secondary shaft brackets 118 and 120 are secured to the clutch housing 50 on opposite sides of the primary roller 32 as seen in FIG. 5. Secondary shafts 122 and 124 are hinged to the shaft brackets 118 and 120, respectively, with bolts 126. The secondary rollers 38 and 40 are rotatably secured on the secondary shafts 122 and 124, respectively, through bearings 128.

The ends of each shaft 122 and 124 opposite the brackets 118 and 120 are secured to bracket 42 with bolts 130. The bracket 42 insures that the secondary rollers 38 and 40 will be maintained in a parallel relationship at all times.

The bracket 42 also supports the locking mechanism 132 which permits locking of the primary roller 32 and secondary rollers 38 and 40 in a parallel relationship for tensioning the tape. The locking mechanism includes a latch 134 pivotally mounted on the bracket 42 through a bolt 136. The latch 134 has a cam face 138 for engagement with the distal end of the primary shaft 44 for locking the rollers into parallel positions. A spring 140 acting between the latch 134 and bracket 42 urges the cam face 138 into engagement with the primary shaft 44 for locking.

The latch 134 can be pivoted out of engagement with the primary shaft 44 for pivoting the secondary rollers away from the primary roller when loading a tape as shown in FIG. 4 by pivoting the latch 134 in the clockwise direction to a position shown in dotted line in FIG. 7. A safety latch 142 can be pivotally mounted on the bracket 42 with a bolt 144 which resists undesired unlatching of the latch 134. The safety latch 142 has a portion 146 overhanging the edge of the handle portion of the latch 134 to prevent it from moving toward the released position until the safety latch is manually pivoted out of the way.

As will be apparent, the pipe tape tensioner 26 will permit application of a constant tension to the tape 12 being applied to the pipe 14 independent of the amount of tape 12 remaining on the adjacent tape supply reel 20. The tension can be varied by simply adjusting the adjusting nut 68 to vary the spring force exerted by clutch springs 104 on the clutch disks 92 and 100. Once adjusted, the adjusting nut can be fixed by use of an adjusting nut lock 148 (not shown) which is secured to the adjusting nut housing 62 and has an extension 150 (not shown) which extends into one of the notches 152 formed about the outer periphery of the adjusting nut 68.

Although only a single embodiment of the present invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the scope and spirit of the invention.

We claim:

1. A device for extering a constant tension on a material for wrapping about pipe, the material being provided from a material source, means defining a support for mounting the material source, and means for rotating said support and material source about the circumference of the pipe and moving the material source and pipe relative to each other along the length of the pipe so that the material is applied to the pipe at an angle oblique to the length of the pipe, the material source being mounted on the support so that the material is supplied from the material source at the oblique angle to the length of the pipe; comprising:

a base having an aperture formed therin, the walls forming said aperture being splined;

means for mounting said base on the support;

a primary roller rotatably mounted on said base, said primary roller having a hub extending into the aperture of said base, said hub being splined, the axis of rotation of the primary roller extending at the oblique angle relative the length of the pipe;

at least one first clutch disk splined to said base within said aperture;

at least one second clutch disk splined to said hub within said aperture;

an adjusting nut threadedly received in the aperture on one side of said first and second clutch disks; and spring means effective on the side of said first and second clutch disks opposite said adjusting nut for urging said clutch disks into contact to generate frictional resistance to rotation of the primary roller relative to the base, movement of the adjusting nut varying the force exerted by said spring means on said clutch disks to vary the frictional resistance to rotation to vary the tension of the material applied on the pipe, the positioning of the rotational axis of the primary roller at the oblique angle ensuring that the tension exerted on the material by the primary roller is uniform across the width of the material.

2. The device of claim 1 further having at least one secondary roller and means for rotatably mounting said secondary roller to said base for defining a material path to insure the material contacts a sufficient area on the outer surface of the primary roller to tension the material.

3. The device of claim 1 further comprising a secondary roller and means for pivotally mounting said secondary roller on said base for pivotal motion away from the primary roller to permit threading of the material through the device.

4. The device of claim 1 further comprising cooling fluid in the aperture in said base for flowing about the splines in the device for cooling.

5. The device of claim 3 further comprising a locking mechanism for locking said second roller parallel to the primary roller during application of the material to the pipe, said locking mechanism having a safety latch to resist undesired unlatching of the latching mechanism.

6. A device for exerting a constant tension on material for wrapping about a pipe, the material being provided from a material source, means being provided for mounting said material source on a support, means being provided for moving the material source and support about the circumference of the pipe, means being provided for moving the material source and pipe relative each other along the length of the pipe so that the material is applied at a predetermined oblique angle to the length of the pipe, comprising:

a base mounted on said support for movement with the material source and having an aperture formed therein, the surface defining the aperture being splined, said base further comprising a primary shaft extending along a first axis centered within said aperture, said first axis extending at the predetermined oblique angle to the length of the pipe;

a primary roller rotatably mounted on said primary shaft, said primary roller having a hub extending into the aperture in said base, said hub being splined;

a plurality of first clutch disks splined to said base within said aperture;

a plurality of second clutch disks splined to said hub within said aperture, said second clutch disks rotating with said primary roller about the first axis while being permitted to move axially along the first axis relative to the hub;

an adjusting nut threadedly received by said base and extending into the aperture to an annular end surface;

a plurality of springs compressing the first and second clutch disks between the springs and said annular end surface, selected ones of said clutch disks having friction surfaces thereon to generate frictional resistance to rotation of the primary roller relative to the base, said adjusting nut being adjustable to vary the force exerted by said springs on the clutch disks to vary the frictional resistance to rotation of the primary roller, the frictional resistance causing the primary roller to tension the material as is being applied to the pipe;

a pair of secondary shafts pivotally mounted to said base on opposite sides of the primary roller;

a secondary roller rotatably mounted on each of said secondary shafts for defining a material path through the device to provide sufficient contact area between the primary roller and the material to tension the material; and a bracket interconnecting the pair of secondary shafts at the end distal from the pivotal connection to the base for maintaining the secondary shafts and secondary rollers in a parallel relationship, said bracket having a locking mechanism thereon for locking the bracket to the primary shaft to maintain the primary roller and secondary rollers in a parallel relationship with the rotational axis of the secondary rollers also extending at the predetermined oblique angle relative to the length of the pipe for applying the material to the pipe.

7. The device of claim 6 further comprising a cooling fluid flowing about the splines in the aperture for cooling and means for accommodating thermal expansion and contraction of the cooling fluid.

8. The device of claim 6 wherein said locking mechanism includes a safety latch for resisting unlocking of the mechanism while materials being applied to the pipe.

* * * * *